US005429656A

United States Patent [19]

Hauner et al.

[11] Patent Number: 5,429,656

[45] Date of Patent: Jul. 4, 1995

[54] SILVER-BASED CONTACT MATERIAL FOR USE IN POWER ENGINEERING SWITCHGEAR

[75] Inventors: Franz Hauner, Röttenbach; Günter Tiefel, Fürth, both of Germany

[73] Assignee: Siemens Aktiengesellschaft, Munich, Germany

[21] Appl. No.: 142,441

[22] PCT Filed: May 14, 1992

[86] PCT No.: PCT/DE92/00388

§ 371 Date: Nov. 24, 1993

§ 102(e) Date: Nov. 24, 1993

[87] PCT Pub. No.: WO92/22080

PCT Pub. Date: Dec. 10, 1992

[30] Foreign Application Priority Data

May 27, 1991 [DE] Germany ..... 41 17 311.2

[51] Int. Cl.[6] ..... C22C 9/12

[52] U.S. Cl. ..... 75/232; 75/235; 75/244; 75/247; 252/514; 252/519; 252/520

[58] Field of Search ..... 75/232, 235, 247, 244; 252/514, 519, 520

[56] References Cited

U.S. PATENT DOCUMENTS

| | | | |
|---|---|---|---|
| 2,394,501 | 2/1946 | Weiller | 75/22 |
| 4,369,063 | 1/1983 | McGowan, Jr. | 106/1.14 |
| 4,808,223 | 2/1989 | Ozaki et al. | 75/238 |
| 4,859,238 | 8/1989 | Weise et al. | 75/233 |
| 4,948,424 | 8/1990 | Haufe et al. | 75/234 |
| 4,980,125 | 12/1990 | Haufe et al. | 419/21 |
| 5,246,480 | 9/1993 | Haufe et al. | 75/236 |

FOREIGN PATENT DOCUMENTS

| | | |
|---|---|---|
| 53-92308 | 8/1978 | Japan . |
| 64-55345 | 3/1989 | Japan . |

OTHER PUBLICATIONS

Vol. 59, No. 7 (*Chemical Abstracts* (Sep. 30, 1963), Electrical Contact of Silver-Ferrous Oxide, col. 7069.

*Primary Examiner*—Ngoclan T. Mai
*Attorney, Agent, or Firm*—Kenyon & Kenyon

[57] ABSTRACT

In particular for contacts in low-voltage switches, the contact material consists of silver and further active components. In accordance with the invention, there are present as active components, in combination, iron oxide ($Fe_2O_3/Fe_3O_4$) in a proportion of between 1 and 50% by weight and at least one oxide of a further chemical element in a proportion of between 0.01 and 5% by weight. In particular, contact materials of the constitution $AgFe_2O_3ReO_2$ and $AgFe_2O_3ZrO_2$ have proven suitable in practice. The manufacture of the material and fabricating of the contacts can be effected by methods of powder metallurgy with the inclusion of molding or extrusion technique.

4 Claims, No Drawings

SILVER-BASED CONTACT MATERIAL FOR USE IN POWER ENGINEERING SWITCHGEAR

FIELD OF THE INVENTION

The present invention relates to a silver-based contact material for use in power engineering switchgear, particularly for contacts in low-voltage switches, in which, in addition to silver, there are present as active components at least iron oxide used main component and at least one further metal oxide as secondary component metal.

BACKGROUND OF THE INVENTION

For contact pieces in low-voltage power engineering switchgear, for instance in power switches as well as in direct-current, motor and auxiliary contactors, contact materials on the one hand of the silver-metal (AgMe) system and on the other hand of the silver-metal oxide (AgMeO) system are known. Representatives of the first system are, for instance, silver-nickel (AgNi) or silver-iron (AgFe); representatives of the second system are in particular silver-cadmium oxide (AgCdO) or silver-tin oxide (AgSnO2). In addition to this, there can be further metal oxides such as, in particular, bismuth oxide ($Bi_2O_3$), copper oxide (CuO) and/or tantalum oxide ($Ta_2O_5$).

The practical utility of a contact material having a base of silver-metal or silver-metal oxide is determined by the so-called electric contact properties spectrum. Controlling parameters are, in this connection, the lifetime number of switchings on the one hand, which is determined by the consumption of the switch piece, and the so-called excess temperature, i.e. the heating of the contact at the contact bridge which results essentially from the electrical resistance of the said contact structure. Sufficiently low tendency to welding-together of the contact pieces and resistance to corrosion are furthermore important since the switch properties can change with time due to long-time corrosion of the material in air-break switchgear.

From DE-A-1 608 211 there is already known an electric contact material of the silver-metal oxide system which can also contain iron oxide in addition to cadmium and/or tin oxide. Furthermore, in DE-C-38 16 895 the use of a silver-iron material with 3 to 30 wt. % iron and one or more of the additions manganese, copper, zinc, antimony, bismuth oxide, molybdenum oxide, tungsten oxide and chromium nitride in amounts of a total of 0.05 to 5% by weight, balance silver, are proposed for electric contacts. In addition, from DE-A-39 11 904 there is known a powder-metallurgy method for the production of a semifinished product for electric contacts from a composite material having a base of silver with iron, in which 5 to 50 wt. % iron is used as first secondary component and 0 to 5% by weight of a second secondary component consisting of one or more substances from the group containing the metals titanium, zirconium, niobium, tantalum, molybdenum, manganese, copper and zinc as well as their oxides and carbides. The iron in elementary form is obtained in this connection in particular by chemical precipitation. Finally, from JP-A-1/055345 a material of the aforementioned type is known which consists of a silver matrix in 0.5 to 20% by weight divided iron oxide particles, in which a part of the iron oxide is replaced by at least one of the oxides of nickel, cobalt, chromium, molybdenum, tungsten, cadmium, zinc, antimony, tin, bismuth, indium, lean, manganese, beryllium, calcium, magnesium or copper. The contact pieces produced therefrom are said to be excellent for use in switches due to good mechanical properties and high arc resistance.

The materials of the prior art in most cases do not satisfy at the same time all requirements of the spectrum of switch properties. In the final analysis, it is desired to achieve for the specific case of use an optimum of in each case the most important parameters which is adapted thereto.

SUMMARY OF THE INVENTION

Proceeding from the above requirements, the object of the invention is to provide further contact materials having a base of silver and iron oxide. These materials are to be characterized by low contact heating with stable heating behavior, little tendency towards welding together, and a long life with respect to the switch current intensities. Furthermore, good corrosion resistance is to be present. In accordance with the invention, this object is achieved by providing a material which, in addition to the iron oxide, also contains as a further active component rhenium oxide and/or bismuth zirconate and/or boron oxide and/or zirconium oxide, the iron oxide being present as a main component in a proportion of between 1 and 50% by weight and the further active (i.e., secondary) components being present in a proportion of between 0.01 and 5% by weight. In this connection, the iron oxide may have the constitution $Fe_2O_3$ or $Fe_3O_4$, or possibly also be a mixed form.

DETAILED DESCRIPTION OF THE INVENTION

Within the scope of the present invention, it has been recognized that, in particular, iron oxide as main active component together with one or more of the metal oxides indicated above as a secondary component improves the spectrum of properties as contact material. The iron oxide is preferably present in amounts of less than 40% by weight and in particular less than 30%. As the further oxide, rhenium oxide, bismuth zirconate, boron oxide or else zirconium oxide may be used individually or in combination, in different weight proportions.

There is particularly advantageous a contact material of the aforementioned type in which the iron oxide is present in proportions of 2 to 20% by weight, with an addition of 0.5 to 2% rhenium oxide and/or 0.05 to 3% bismuth zirconate and/or 0.05 to 0.5% boron oxide and/or 0.05 to 2% zirconium oxide, balance silver. The boron oxide is preferably boric acid.

Further details and advantages of the invention will become evident from the following description of embodiments. In this connection, there is described on the one hand different methods of producing the material claimed and, on the other hand, the attached table containing individual examples of concrete compositions of material in accordance with the invention.

In the table, measured values are indicated for the excess temperature of the materials claimed, each of which was measured on the contact bridge of the switchgear. In the first column of the measured temperature values, there is set forth the maximum excess temperature and in the second column of the measured temperature values there is set forth the mean bridge temperature as they result in each case as difference in temperature from room temperature. The measured temperature values were obtained in switching tests in a 15 kW contactor up to a number of switchings of $n_s = 50{,}000$ switchings.

The table covers three embodiments with informative compositions of the contact material claimed. In this connection, the manufacture of the actual material and the fabrication of the corresponding contacts can be carried out in accordance, in part, with different methods. The measured value of the materials in accordance with the invention is compared with $AgFe_2O_3$ 6,4. Furthermore, an AgFe9 contact material is contained in the table. The results will be discussed in detail further below.

First Method of Manufacture:

For the manufacture of a contact material $AgFe_2O_3$ 5,7 $ReO_2$1,1, corresponding proportions of powdered silver, powdered iron oxide and powdered rhenium oxide are mixed. For this, commercial powdered iron oxide or rhenium oxide is used.

By wet mixing of the powdered oxide a powder mixture is prepared. Strips or wires of the material are first of all produced from the powder mixture by so-called extrusion as semifinished product for the contact pieces. The process conditions with respect to temperature on the one hand and pressure on the other hand are so selected that an undesired evaporation of rhenium is taken into account. For a dependable bonding technique it is advantageous to produce strips with a solderable silver layer by the two-layer extrusion method. Contacts of directional structure can then be cut from the semifinished product thus produced.

In an identical manner of procedure, the proportions of silver, iron oxide and rhenium oxide can be varied. A material having the composition $AgFe_2O_3$5,7 $ReO_2$2,2 was also examined.

Second Method of Manufacture:

In another method, the contacts were produced by molding. This is particularly advantageous when the further oxide as secondary active component is not rhenium oxide but, for instance, zirconium oxide. For this purpose again, corresponding proportions of powdered silver, powdered iron oxide and powdered zirconium oxide are mixed together. Specifically, a material having the composition $AgFe_2O_3$5,4$ZrO_2$1,0 was examined.

It may furthermore be advantageous to use, in addition to powdered silver and powdered iron oxide, as further addition a powder consisting of a mixture of two or more components of rhenium oxide, bismuth zirconate, boron oxide and zirconium oxide. With suitable adaptation of the proportions of such a mixture, the specific advantages of the individual addition oxides can be combined with each other.

After wet mixing for a suitable period of time, moldings are compressed from the powdered mixture to form contacts with a pressure of about 200 MPa. For a dependable technique of bonding the contact to the contact support by brazing, it is furthermore advantageous, in this pressing process, to compress a second layer of pure silver jointly with the actual contact layer so as to form a two-layer contact.

The moldings are thereupon sintered at a temperature of about 850° C. for about one hour. In order to obtain the least possible porosity of the final contacts, the sintered bodies are then further pressed under a pressure of about 1000 MPa and again sintered for about one hour at about 800° C. The calibrating of the contacts produced in this manner is again effected with a pressure of about 1000 MPa.

For the production of suitable silver/metal oxide powder mixtures, it is also possible to use a long-time mixing of the silver and individual oxide powders in the manner of so-called mechanical alloying. In this way, the structural properties of the final material are advantageously influenced. The fabricating of the contacts can in each case again be effected optionally by extrusion or molding. Particularly upon the use of rhenium oxide as additional active component, possible evaporation of the rhenium must again be taken into account. This danger is not present in the case of zirconium oxide.

The table shows that in the first two examples of the material of the invention there is an average bridge temperature which lies above the value of AgFe9 and also $AgFe_2O_3$6,4. As compared with this, the corresponding value in the third example is below the comparative examples. It is to be noted that AgFe—and $AgFe_2O_3$ materials show in this connection a similar temperature behavior. As a whole, all values for the mean bridge temperature lie within a range of 70 ±5K.

Aside from the mean bridge temperature it is however now found that the maximum excess temperature in the case of all the materials of the invention is significantly below the comparative examples. In particular, the statistically occurring maximum values of the excess temperature, which can lead to damage to the switchgear could, however, scarcely be controlled up to now.

From the measured values, it can thus be noted that an addition of either rhenium oxide or, in particular, zirconium oxide decisively stabilizes the temperature behavior of an $AgFe_2O_3$ material. The latter is expressed in the clearly lower maximum excess temperature.

In accordance with the table, $AgFe_2O_3ReO_2$ and $AgFe_2O_3ZrO_2$ materials were examined in detail. The same positive influence as of rhenium oxide or zirconium oxide can be expected also on the part of other suitable oxide additions. For example, bismuth zirconate ($2Bi_2O_3 \times 3ZrO_2$) or boric acid ($H_3BO_4$) can be used as suitable secondary components for the iron oxide. Mixtures of the individual components are also possible.

In the materials of the invention, the iron oxide can be present not only in the chemical constitution $Fe_2O_3$ but also in the constitution $Fe_3O_4$, or in a mixed form. In detail, it is found that the iron oxide should be present, in particular, in proportions of 2 to 20% by weight, the addition of rhenium oxide should be between 0.5 and 5%, the addition of bismuth zirconate between 0.05 and 3%, the addition of boric acid between 0.05 and 0.5%, and the addition of zirconium oxide between 0.05 and 2%.

TABLE

| Material | $T\ddot{U}_{(max)}$ in K | Mean Bridge Temp. in K |
|---|---|---|
| $AgFe_2O_3$6,4 | 162 | 71 |
| $AgFe_2O_3$5,7$ReO_2$1,1 | 109 | 75 |
| $AgFe_2O_3$5,7$ReO_2$2,2 | 120 | 73 |
| $AgFe_2O_3$5,4$ZrO_2$1,0 | 89 | 66 |
| AgFe9 | 145 | 67 |

What is claimed is:

1. A silver-based contact material for use in power engineering switchgear, comprising: a base of silver, an iron oxide selected from the group consisting of $Fe_2O_3$ and $Fe_3O_4$ and mixtures thereof as a main active component, and at least one further metal component selected from the group consisting of rhenium oxide ($ReO_2$), bismuth zirconate ($2Bi_2O_3x3ZrO_2$), boron oxide, boric acid ($H_3BO_4$) and zirconium oxide ($ZrO_2$) and mixtures thereof as a secondary active component, wherein the iron oxide main active component is present in a proportion of between 1 and 50% by weight with respect to the silver-based contact material and the secondary active component is present in a proportion of between 0.01 and 5% by weight with respect to the silver-based contact material.

2. The contact material according to claim 1, wherein the iron oxide is present in a proportion of less than 40% by weight.

3. The contact material according to claim 2, wherein the iron oxide is present in a proportion of less than 30% by weight.

4. A silver-based contact material for use in power engineering switchgears, comprising: 2 to 20% by weight of an iron oxide selected from the group consisting of $Fe_2O_3$ and $Fe_3O_4$ and mixtures thereof as a main active component; at least one of 0.5 to 3% rhenium oxide ($ReO_2$), 0.05 to 3% bismuth zirconate ($2Bi_2O_3x3ZrO_2$), 0.05 to 0.5% boric acid ($H_3BO_4$) and 0.05 to 2% zirconium oxide ($ZrO_2$) as a secondary active component; and a balance of silver wherein the total proportion of the secondary active component is no more than 5% by weight of the material.

* * * * *